United States Patent [19]

Latimer et al.

[11] 4,222,207

[45] Sep. 16, 1980

[54] APPARATUS AND METHOD FOR ERECTING A MOBILE HOME ON A PREEXISTING LOT

[75] Inventors: Robert C. Latimer, Irvine; Gary W. Pomeroy, Corona Del Mar, both of Calif.

[73] Assignee: Golden West Homes, Santa Ana, Calif.

[21] Appl. No.: 937,434

[22] Filed: Aug. 28, 1978

[51] Int. Cl.[2] ..... E02D 27/00

[52] U.S. Cl. ..... 52/169.3; 52/79.1; 52/234

[58] Field of Search ..... 52/169.3, 143, 79.1, 52/234, 169.2

[56] References Cited

U.S. PATENT DOCUMENTS 3,640,037 2/1972 Renauld et al. ..... 52/169.3

3,874,137 4/1975 Gentry ..... 52/169.3

FOREIGN PATENT DOCUMENTS 107760 9/1898 Fed. Rep. of Germany ..... 52/79.1

*Primary Examiner*—James A. Leppink
*Assistant Examiner*—Carl D. Friedman
*Attorney, Agent, or Firm*—Poms, Smith, Lande & Rose

[57] ABSTRACT

Apparatus and method for erecting a mobile home on a preexisting elongated rectangular lot. The home is comprised of four elongated rectangular sections which are erected on the lot so that each pair of sections forms an elongated rectangular dual section, one of the dual sections being erected on the lot so that it abuts the other dual section along about one-half the linear extent thereof thus forming a pair of diagonally opposed generally square areal spaces on the lot eliminating the boxy appearance of conventional mobile home layouts.

10 Claims, 3 Drawing Figures

APPARATUS AND METHOD FOR ERECTING A MOBILE HOME ON A PREEXISTING LOT

BACKGROUND OF THE INVENTION

1. Field of the Invention

The invention relates to mobile homes; and, more particularly, to apparatus and method for erecting a mobile home on a preexisting lot.

2. Description of the Prior Art

The majority of all mobile homes that are constructed are boxy in layout and located in mobile home parks. Since such homes are usually designed and constructed as low cost housing, mobile home parks are likewise designed to minimize costs which results in high density housing and lot layout patterns that are similar.

Further, various states have regulations that control the design and construction of such parks, usually restricting the homes to specific minimum set-backs and clearances from lot lines and other buildings. In order to obtain the highest densities within the limits of the various park regulations, the typical lot size will usually vary from about 50 to 55 feet in width to about 70 to 80 feet in length with respect to parks designed for double width homes. The majority of such parks are constructed based on this lot size.

These typical lots utilize a one car carport or driveway on one side of the home and a long and narrow patio area on the other side. These long and narrow configurations result in an inefficient use of space and lack of privacy due to full frontage of these areas on adjoining lots. Thus, consumers complain about the boxy appearance, not only of the mobile homes themselves, but the aforementioned layout.

The preexisting design layout of such lots has hindered attempts to relieve such boxiness. There is a need for a mobile home layout which eliminates both the boxiness of the mobile home itself and the arrangement of the home on the preexisting lot.

SUMMARY OF THE INVENTION

It is an object of this invention to provide apparatus and method for relieving the boxiness of conventional meobile homes and their orientation on preexisting lots, It is a further object of this invention to provide apparatus and method for laying out a mobile home in a manner making more acceptable usage of space on a typical lot.

It is still further an object of this invention to provide apparatus and method for laying out a mobile home on a preexisting lot in a manner resulting in greater privacy than known mobile home layouts.

These and other objects are preferably accomplished by providing four elongated rectangular sections on the lot erected thereon so that each pair of sections forms an elongated rectangular dual section, one of the dual sections being erected on the lot so that it abuts the other dual section along about one-half the linear extent thereof thus forming a pair of diagonally opposed generally square areal spaces on the lot eliminating the boxy appearance of conventional mobile home layouts.

DESCRIPTION OF THE PREFERRED EMBODIMENT

Figure 1:
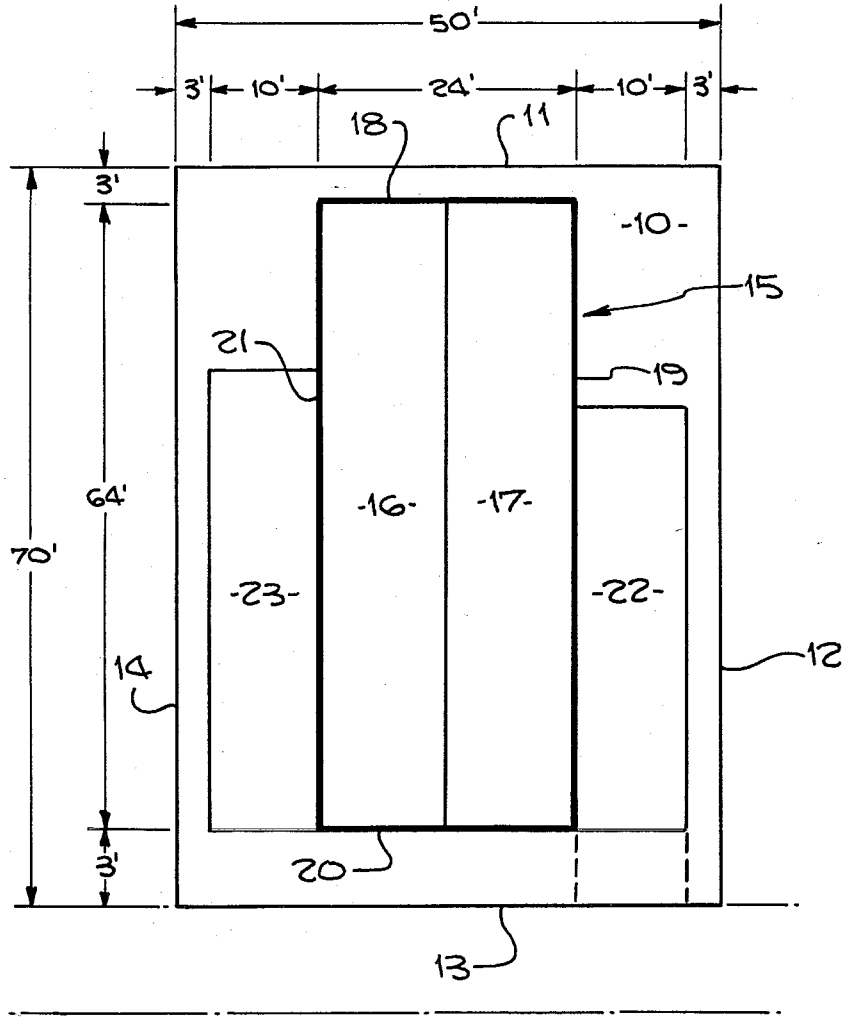
Fig. 1. PRIOR ART
FIG. 1 is a top plan schematic view of a conventional mobile home layout.

Referring to FIG. 1 of the drawing, a preexisting lot 10 is shown within rectangular border lines 11 through 14. Such lot 10 is generally about 50 to 55 feet or so in overall width (i.e., the length of lines 11, 13) and about 70 to 80 feet in overall length (i.e., the length of lines 12, 14). The majority of mobile home parks are constructed based on this conventional lot size. Conventional mobile homes come in various layouts, one such being the so-called double wide mobile home which is formed by two adjoining sections. It can be appreciated that state laws and highway design limit the overall width of mobile homes that can be transported. One such solution is to provide double wide mobile homes which, when erected on a preexisting lot, form a mobile home having an overall width substantially greater than that which can be transported in one piece. For example, a mobile home 15 is shown laid out on lot 10 comprised of an adjoining pair of rectangular sections 16, 17. Each section 16, 17 may be about 12 feet or so in overall width thus providing a home having an overall width of about 24 feet. Rectangular border lines 18 through 21 circumscribe mobile home 15 on lot 10.

A carport area 22 is shown along one elongated side of home 15 and a patio area 23 is shown along the other elongated side of home 15. It can be seen that the overall layout of FIG. 1 is very boxy in both the home and lot and the patio 23 fronts on an adjacent lot (assuming another lot next to lot 10). Carport 22 accessible from the adjacent roadway permits only linear parking and of course also fronts the adjacent lot. In the prior art layout of FIG. 1, the spacing between border line 20 of home 15 and border line 13 of lot 10, and border line 18 of home 15 and border line 11 of lot 10, may be only about 3 feet (assuming lot 10 to be about 70 feet in length, as shown). The distance between the edge of patio 23 and line 14, and the edge of carport 22 and line 12, may also be about 3'. This creates a cramped layout lacking privacy and presenting an overall boxy effect.

Figure 2:
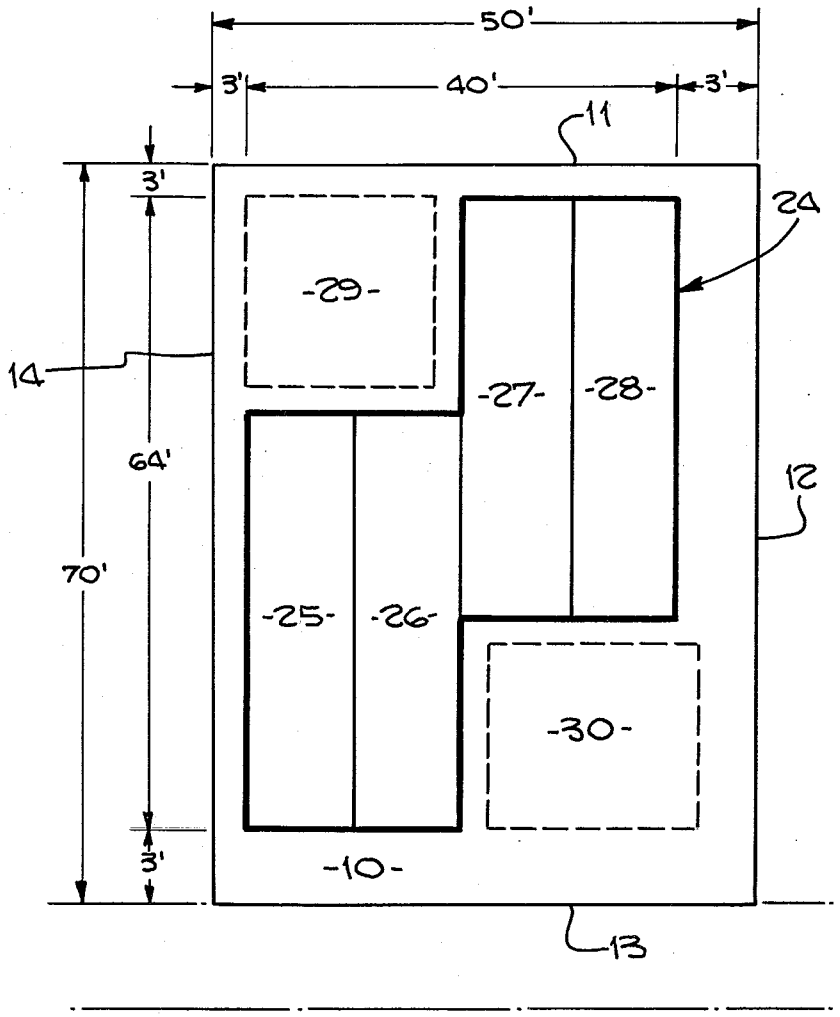
FIG. 2 is a top plan schematic view of a mobile home layout in accordance with the teachings of our invention.

Referring now to FIG. 2, preexisting lot 10, identical to that of the lot of FIG. 1, is shown also bordered by border lines 11 through 14. As particularly contemplated in the present invention, a multisectional mobile home 24 is shown comprised of preferably four parts or sections 25 through 28. Each section 25 through 28 is preferably about 10 feet or so in width and about 42 feet or so in overall length. Four such sections 25 through 28 thus will have an overall square footage of about 1680 sq. feet as opposed to the 1536 sq. feet of the conventional mobile home 15 of FIG. 1. Thus, this layout not only allows for more efficient usage of lot space, as will be discussed, but accomplishes the same without a reduction in floor area.

Referring again to FIG. 2, a patio area 29 is formed by the layout of mobile home 24 on lot 10. This square patio area affords a more useful area and increases the overall privacy thereof. The garage or carport area 30 (shown detached but could of course be attached to home 24) is also square shaped and permits side-by-side parking it is accessible from the adjacent roadway.

Thus, the two open areas 29, 30 at the front and rear of the lot vacated by offsetting sections 25 through 28, as illustrated, are sized to permit the addition of a double garage or carport and accomodate the more useful square patio area.

Figure 3:
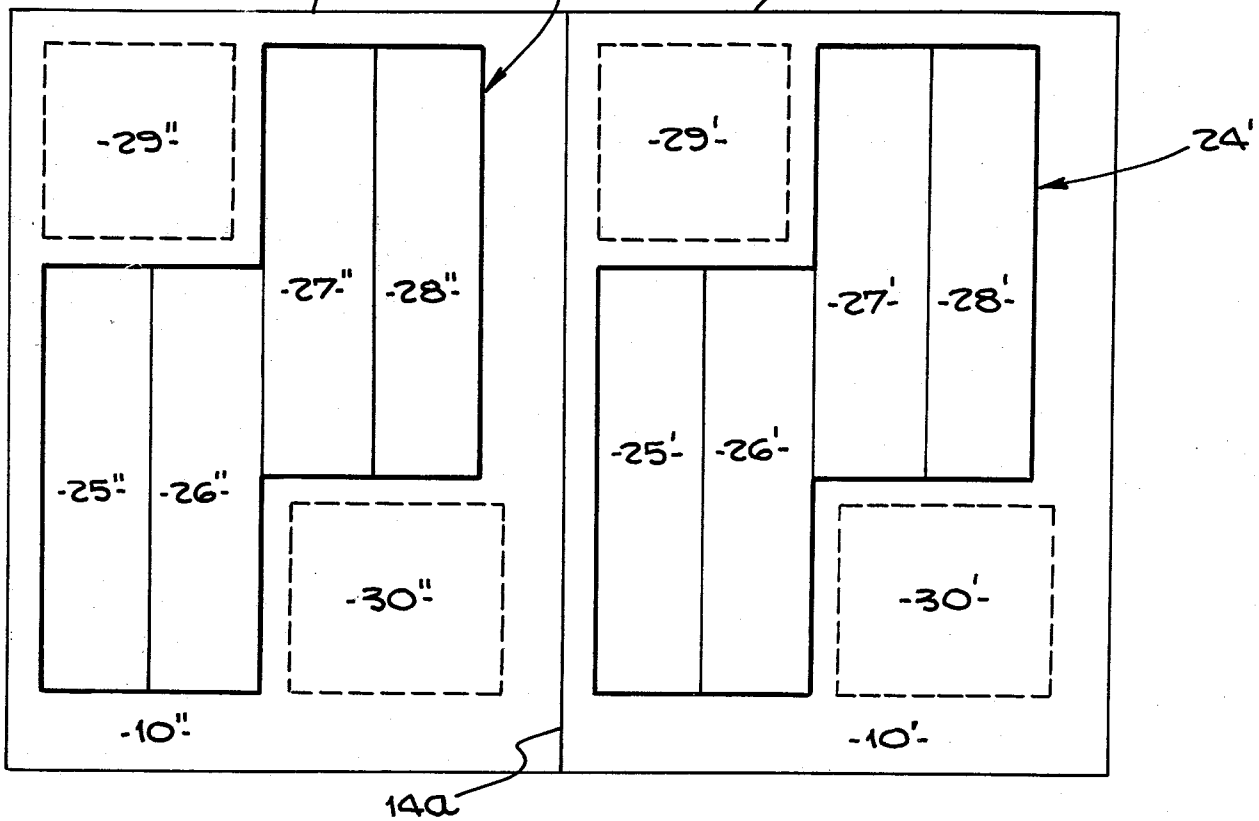
FIG. 3 is a top plan schematic view of two side-by-side layouts on two adjacent lots in accordance with the invention.

Thus, sections 25, 26 are aligned with each other but offset from aligned sections 27, 28. For example, sections 25, 26 may extend to about the midpoint of aligned sections 27, 28. These sections 25 through 28 are transported individually along a highway to the mobile home park, then erected on preexisting lots, such as lot 10, in the manner illustrated. The multi-sectional design utilizes a unique arrangement of the individual floor sections of the home to obtain a more acceptable usage of space on a typical mobile home park lot. The resulting unoccupied area of the lot allows for side by side automobile parking or a two car garage with a wider and more private rear patio area. This arrangement eliminates the boxy appearance typical of a conventional mobile homes and provides architecturally pleasing lines. The 10 feet or so wide sections 25 through 28 allow for the easy addition of roof eaves and higher pitched roofs which still comply with the highway movement regulations of most states. As discussed hereinabove, it is assumed that a second lot is next to lot 10 of FIGS. 1 and 2. Thus, as shown in FIG. 3, lots 10' and 10'' (each similar to lot 10) abut one another separated by lot line 14*a*. Sections 25', 26' and 25'', 26'' correspond to sections 25, 26 of FIG. 2. Likewise, sections 27', 28' and 27'', 28'' correspond to sections 27, 28 of FIG. 2. Open areas 29', 29'' on each lot 10' and 10'' correspond to open area 25 on lot 10 of FIG. 2 whereas open areas 30', 30'' on each lot 20' and 10'' correspond to open area 30 of lot 10 of FIG. 2. Thus, mobile homes 24' and 24'', identical to home 24 of FIG. 2, are disposed on each lot 10' and 10'' in the same manner as lot 10' of FIG. 2. It can be seen that the open area 30'' and lot 10'' is shielded by sections 25', 26' from open area 30' on lot 10'. In like manner, open area 29' on lot 10' is screened from open area 29'' on lot 10'' by sections 27'', 28''. This creates private areas on each lot which of course is continued onto the next lot without a boxy appearance being created.

Other than within the limits stated, the sections 25 through 28 may of course vary. However, the dimensions given are preferred to provide minimum and maximum dimensions as illustrated for erection on preexisting typical mobile home lots.

We claim as our invention:

1. A method for erecting at least a pair of mobile homes on at least a pair of generally elongated rectangular adjacent lots, each of said lots circumscribed by a pair of spaced substantially parallel elongated boundary lines interconnected by a pair of short spaced substantially parallel boundary lines, said method comprising the steps of:

transporting at least four elongated rectangular mobile home sections of substantially the same size and configuration to each said lot;

aligning two of said sections in side-by-side relationship on each of said lots thereby forming a first elongated rectangular dual section on each of said lots;

aligning the other two of said sections in side-by-side relationship to the first two of said sections on each of said lots thereby forming a second elongated rectangular dual section on each of said lots;

erecting one of said dual sections on each of said lots adjacent to, generally parallel to and extending along an elongated boundary line of each of said lots and spaced both a short distance from one of the short boundary lines of each of said lots and a longer distance from the other of the short boundary lines of said each of said lots; and erecting the other of said dual sections on each of said lots into abutting relationship with said one of said dual sections and adjacent to, generally parallel to and extending along the other elongated boundary line of each of said lots and spaced both a short distance from the other of said short boundary lines of each of said lots and a longer distance from said one of the short boundary lines of each of said lots, said other of said dual sections being in abutting engagement with said one of said dual sections along about one-half of said one of said dual sections, thereby forming a pair of generally square-shaped areal spaces disposed only at opposite diagonal ends of each of said lots, one said space being at the front of each of said lots adjacent to and accessible from an adjacent roadway to permit side-by-side parking of two cars, and the other said space being at the rear of each of said lots and separated from the roadway by two said sections, the pair of dual sections on one of said lots being oriented on said one of said lots substantially the same as the pair of dual sections on the other of said lots so that the pair of areal spaces on one of said lots are separated from the pair of areal spaces of the other of said lots by said sections thereby providing privacy between the areal spaces on one of said lots from the areal spaces on the other of said lots.

2. In the method of claim 1 wherein each of said lots is about 50 to 55 feet in overall width and about 70 to 80 feet in overall length and the step of transporting said four sections includes the step of transporting four sections to each of said lots of about 10 feet each in overall width and 42 feet each in overall length.

3. In the method of claim 2 wherein the step of erecting both of said dual sections on each of said lots includes the step of leaving a clearance between the dual sections and said boundary lines of each of said lots of at least about 3 feet.

4. In the method of claim 3 wherein the step of erecting said dual sections includes the step of erecting said dual sections on each of said lots so that the overall length thereof is about 64 feet and the overall width thereof is about 40 feet.

5. In the apparatus of claim 1 wherein each of said lots is about 50 to 55 feet in overall width and about 70 to 80 feet in overall length, each of said four sections on each of said lots being about 10 feet in overall width and about 42 feet in overall length.

6. In the apparatus of claim 5 wherein the spacing between said dual sections and the boundary lines of each of said lots is a minimum of about 3 feet.

7. In the apparatus of claim 6 wherein the overall length of said dual sections erected on each of said lots is about 64 feet and the overall width thereof is about 40 feet.

8. In combination a pair of adjacent lots, each of said lots being a generally elongated rectangular lot circumscribed by a pair of spaced substantially parallel elongated boundary lines interconnected by a pair of short spaced substantially parallel boundary lines, said combination comprising:

four independent mobile home sections on each of said lots, each of said sections being elongated rectangles substantially the same length and width, two of said sections being erected on one of said lots and aligned and abutting each other to form a first elongated rectangular dual section, the other of said sections being erected on said one of said lots and aligned and abutting each other to form a second elongated rectangular dual section, the first of said dual sections being linearly aligned along one elongated boundary line of said one of said lots and generally parallel thereto and spaced both a short distance from one of the short boundary lines of said one of said lots and a longer distance from the other of the short boundary lines of said one of said lots, the other said dual sections abutting against and extending along about one-half of said first of said dual sections linearly aligned along the other elongated boundary line of said one of said lots and generally parallel thereto and spaced both a short distance from the other of said short boundary lines of said one of said lots and a longer distance from said one of the short boundary lines of said one of said lots, thereby forming diagonally opposed generally square areal spaces disposed only at opposite corners of said one of said lots, one said space being at the front of the last-mentioned lot adjacent to and accessible from an adjacent roadway to permit side-by-side parking of two cars, and the other said space being at the rear of the last-mentioned lot and separated from the roadway by two sections and four independent mobile home sections substantially similar to said first-mentioned mobile home sections being erected on the other of said lots and oriented thereon substantially the same as said first-mentioned sections so that the areal spaces on one of said lots are separated from the areal spaces on the other of said lots by said sections thereby providing privacy between the areal spaces on one of said lots from the areal spaces on the other of said lots.

9. A method for erecting at least a pair of mobile homes on generally elongated rectangular lots, each of said lots being circumscribed by a pair of spaced substantially parallel elongated side boundary lines interconnected by a pair of short spaced substantially parallel front and rear boundary lines comprising the steps of:

transporting at least three elongated rectangular mobile home sections of substantially the same size and configuration to each of said lots;

aligning two of said sections in side-by-side relationships on each of said lots, thereby forming an elongated rectangular dual sections on each of said lots;

erecting said dual sections on each of said lots adjacent to, generally parallel to and extending along an elongated side boundary line of each of said lots and spaced both a short distance from the rear boundary lines of each of said lots and a longer distance from the front boundary line of each of said lots; and erecting the other said section on each of said lots into abutting relationship with said dual section on each of said lots and generally parallel to the other elongated side boundary line of each of said lots and spaced both a short distance from the front boundary line of each of said lots and a longer distance from the rear boundary line of the each said lot, said other section being in abutting engagement with said one section of said dual section along about one-half of said one of said dual sections on each of said lots thereby forming a generally square-shaped areal space on each of said lots disposed between said dual sections and the front boundary line of each of said lots to permit the parking of two automobiles side-by-side on each of said lots, and forming a space between the other section and the rear boundary line and separated from the front boundary line by said other section on each of said lots so that the pair of areal spaces on one of said lots are separated from the pair of areal spaces of the other of said lots by said sections thereby providing privacy between the areal spaces on one of said lots from the areal spaces on the other of said lots.

10. In combination, at least a pair of mobile homes on at least a pair of generally elongated rectangular lots, each of said lots circumscribed by a pair of spaced substantially parallel elongated side boundary lines interconnected by a pair of short spaced substantially parallel front and rear boundary lines comprising:

three independent mobile home sections on each of said lots, each of said sections being elongated rectangles substantially the same length and width, two of said sections being erected on each of said lots and aligned and abutting each other to form an elongated rectangular dual sections on each said lot and said dual section on each said lot being linearly aligned along one elongated side boundary line of each of said lots and generally parallel thereto and spaced both a short distance from the rear boundary line of each of said lots and a longer distance from the front boundary line of each of said lots, the other of said sections abutting against and extending along about one-half of said sections of said dual sections and generally parallel to the other side boundary line of each of said lots, and spaced both a short distance from the front boundary lines of each of said lots and a longer distance from the rear boundary line of each of said lots, thereby forming a generally square areal space disposed between said dual section and the front boundary line of each of said lots to permit parking of two automobiles, side-by-side, on each lot and forming a space between the other section and the rear boundary line and separated from the front boundary line by said other section on each of said lots so that the pair of areal spaces on one of said lots are separated from the pair of areal spaces of the other of said lots by said sections thereby providing privacy between the areal spaces on one of said lots from the areal spaces on the other of said lots.

* * * * *

Disclaimer and Dedication 4,222,207.—*Robert Clayton Latimer,* Irvine and *Gary Warren Pomeroy,* Corona Del Mar, Calif. APPARATUS AND METHOD FOR ERECTING A MOBILE HOME ON A PREEXISTING LOT. Patent dated Sept. 16, 1980. Disclaimer and Dedication filed Dec. 3, 1981, by the assignee, *Golden West Homes.*

Hereby disclaims and dedicates to the Public the remaining term of said patent.

[*Official Gazette February 16, 1982.*]